US006698501B2

(12) United States Patent
Fleischman

(10) Patent No.: US 6,698,501 B2
(45) Date of Patent: Mar. 2, 2004

(54) HEAT EXCHANGERS THAT CONTAIN AND UTILIZE FLUIDIZED SMALL SOLID PARTICLES

(76) Inventor: William H. Fleischman, 836 Rio Dr., Friendsville, TN (US) 37737-2032

( * ) Notice: Subject to any disclaimer, the term of this patent is extended or adjusted under 35 U.S.C. 154(b) by 167 days.

(21) Appl. No.: 09/911,681

(22) Filed: Jul. 25, 2001

(65) Prior Publication Data

US 2003/0019613 A1 Jan. 30, 2003

(51) Int. Cl.[7] ..... F28D 13/00

(52) U.S. Cl. ..... 165/104.16; 165/104.15; 165/902; 165/10; 422/145; 422/146

(58) Field of Search ..... 165/10, 104.16, 165/902, 104.26; 422/145, 146

(56) References Cited

U.S. PATENT DOCUMENTS 2,586,250 A * 2/1952 Parker ..... 263/51
2,616,668 A * 11/1952 Van Weenen et al. ..... 165/10
4,114,600 A * 9/1978 Newton ..... 126/271
4,522,252 A * 6/1985 Klaren ..... 165/1
4,585,051 A * 4/1986 Leung et al. ..... 165/1
4,640,339 A * 2/1987 Klaren ..... 165/1
4,865,122 A * 9/1989 Brown ..... 165/104.16
5,123,480 A * 6/1992 Dixit ..... 165/104.16
5,687,706 A * 11/1997 Goswami et al. ..... 126/263.01
6,105,659 A * 8/2000 Pocol et al. ..... 165/10
6,263,958 B1 * 7/2001 Fleishman ..... 165/104.16
6,302,188 B1 * 10/2001 Ruhl et al. ..... 165/10

* cited by examiner

*Primary Examiner*—Henry Bennett
*Assistant Examiner*—Nihir Patel
(74) *Attorney, Agent, or Firm*—Robert E. Bushnell, Esq.

(57) ABSTRACT

Heat exchangers utilizing flat surfaced passages to contact, contain and utilize fluidized small solid particles is provided. Top and bottom woven wire mesh or perforated sheet corrugated with rounded or flat-sided ridges are attached to respective top and bottom sides of said passage to increase its surface and to prevent said small solid particles from exiting said heat exchanger. A variety of shapes of the small solid particles are provided to further enhance the heat transfer rate. More energy efficient systems of all kinds will result from the use of these smaller heat exchangers.

18 Claims, 7 Drawing Sheets

HEAT EXCHANGERS THAT CONTAIN AND UTILIZE FLUIDIZED SMALL SOLID PARTICLES

BACKGROUND OF THE INVENTION

1. Field of the Invention

This invention relates to heat exchangers generally, and, more particularly, to heat exchange processes and to heat exchangers that contain and utilize fluidized small solid particles to improve the transfer of heat on one side of the wall that separates two fluids.

2. Background Art

High heat transfer rates have been reported for surfaces immersed in small solid particles that are suspended and kept in motion by an upward flow of a fluid. The overall heat transmission coefficient of a heat exchanger is in the range from 35 to 50 BTU/hr° F.ft$^2$ (i.e. British thermal unit per hour-degree Fahrenheit-square foot). Details of the heat exchanger are described in my pending U.S. patent application Ser. No. 09/028,053 filed on Feb. 23, 1998. The heat exchanger includes a fluidized bed of small solid particles that are suspended in a flow of a fluid in which the downward tendency of the small solid particles to fall by gravity is equaled by the upward drag force of the fluid flow. The heat exchanger includes a plurality of flat surfaced pipes or tubes, a top woven wire mesh or perforated sheet disposed on top surfaces of the flat surfaced pipes, and a grid plate disposed on bottoms of the flat surfaced pipes. The small solid particles are disposed between the flat surfaced pipes and between the top woven wire mesh and the grid plate. This heat exchanger, however, needs additional new features for the top woven wire mesh or perforated sheet and the grid plate to make the heat exchanger more efficient.

SUMMARY OF THE INVENTION

It is an object of the present invention to provide an improved heat exchanger exhibiting increased efficiency.

It is another object to provide a heat exchanger that maintains the same capacity although constructed smaller in size.

It is still another object to provide a heat exchanger having folded and shaped woven wire mesh or perforated sheets able to reduce the overall pressure drop within the heat exchanger during operational service.

It is yet another object to provide an improved orifice plate equipped with a plurality of orifices allowing fluid passage.

It is a further object to provide a heat exchanger having a more efficient fluidized bed.

It is also an object to provide a heat exchanger able to improve heat exchange rates by using small solid particles having tetrahedron or pyramid shapes.

These and other objects may be achieved with a heat exchanger that contains solid particles in a fluidized bed inside the heat exchanger, that has heat transfer surfaces that are not immersed in the solid particles, that has a loosely packed fluidized bed of small solid particles, that generally only allows a bubbling boiling movement of the solid particles direction rather than allowing a circulating motion, that does not need to use devices to restrain the fluidized bed, does not require any special coating on the heat exchanger surface, that has no vertical tubes, that maintains the two fluids exchanging beat separate from each other, does not require using heating elements in the fluidized bed, that uses flat walls to increase the heat transfer coefficient, that does not use slits or slots, that does not have a space between the distributor plate and the bottom of the tube inlets that creates circulating fluid patterns, that does not require embedding larger particles in the fluidized bed, and uses small solid particles with shapes that allow for an increased amount of heat exchange. This should allow heat exchangers of all types to be made smaller than priorly possible while still maintaining the same level of heat transfer between the two fluids.

The heat exchanger includes flat surfaced pipes or tubes conveying one of the fluids involved horizontally. The flat surfaced pipes are spaced-apart from each other and firmly attached to a grid plate that is perforated with orifices that introduce the other fluid involved in the heat exchange process and flowing upward and between the flat surface pipes. A top woven wire mesh or perforated sheet is held tightly against the tops of the flattened pipe or tubes to keep the small solid particles from falling out from a top portion of the heat exchangers between the tops of the flattened pipe when the heat exchangers are handled. The bottom woven wire mesh or perforated sheet is held tightly against the bottom or inlet side of the grid plate to keep the small solid particles from draining out from a bottom portion of the heat exchanger between the bottoms of the flattened pipe whenever the heat exchanger has no upward flowing fluid through the orifices. The small solid particles are disposed to move within a heat exchanging space defined between the flat surfaced pipes and between the top woven wire mesh or perforated sheet and the bottom woven wire mesh or perforated sheet. Bubbles are formed above the orifices whenever more fluid is introduced through the orifices than will pass through the spaces between the small solid particles.

The woven wire mesh or perforated sheets on the top and bottom can be folded or shaped to both increase their respective surface areas and decrease the volume of the heat exchanging space which will thereby reduce the overall pressure drop when in service. Some versions of the improved heat exchangers may be constructed without any orifice plate. The orifice plate may contain one or more orifices in a given enclosed area. The orifices may be round, square or of some other shape. Tetrahedron or pyramid shaped particles may be used for the small solid particles to be manufactured.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings in which like reference symbols indicate the same or similar components, wherein.

DESCRIPTION OF THE PREFERRED EMBODIMENT

Figure 1:
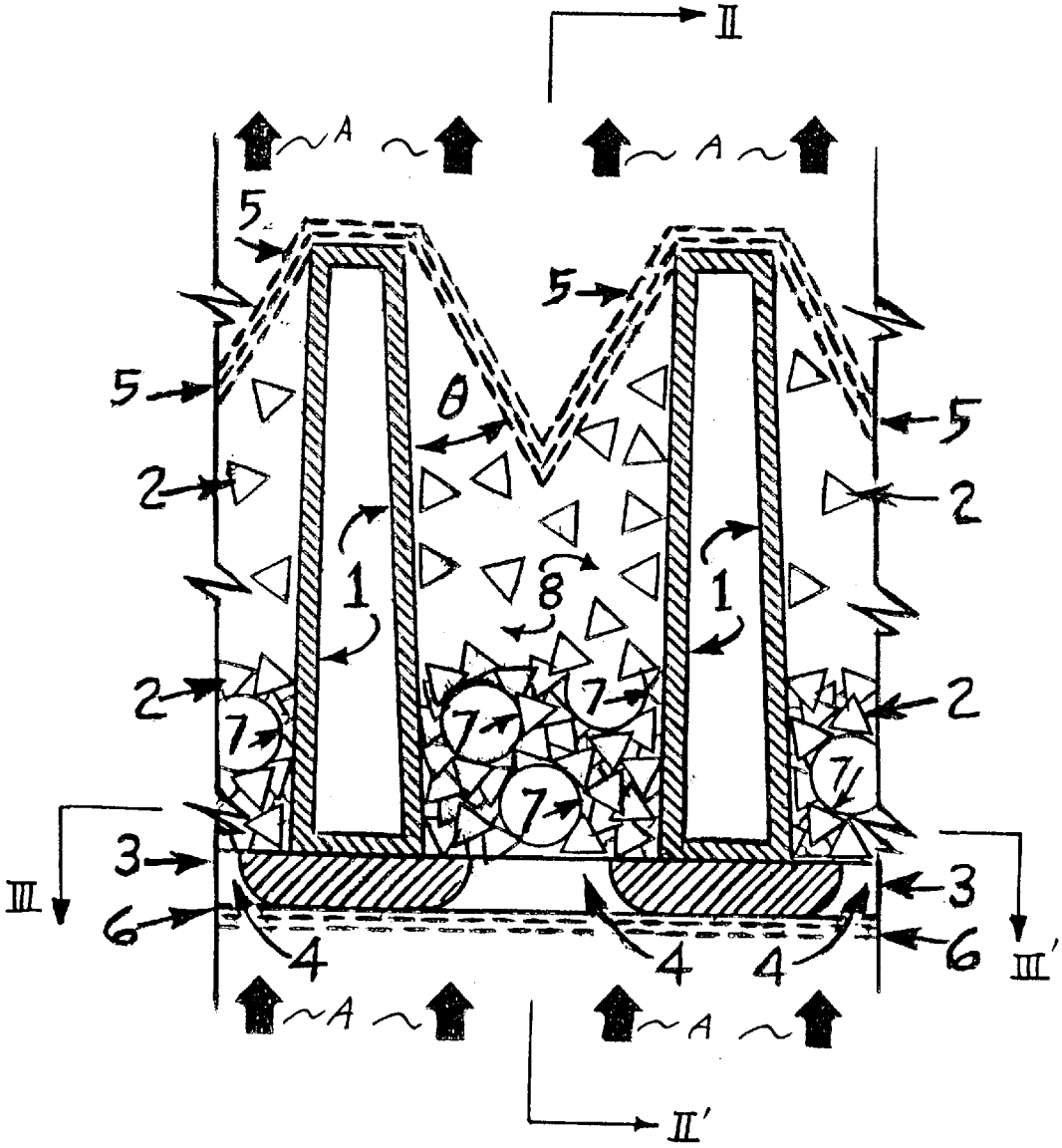
FIG. 1 is a cross-sectional view of the heat exchanger that is at a right angle to the flat surfaced pipe or tubing that conveys one of the fluids horizontally.

Turning now to the drawings, FIG. 1 is a cross-sectional view of a heat exchanger when viewed at a right angle to a plurality of parallel and horizontally spaced-apart flat surfaced pipes or tubes 1 that convey one of the fluids involved in a heat exchange process horizontally. The direction of the second fluid that is conveyed through the heat exchanger is denoted by arrows A. Small solid particles 2 are drawn as triangles to represent tetrahedrons, which is one of the preferred shapes for particles. Preferably, particles 2 are solid. Flattened pipe or tube 1 is attached to a grid plate 3 that is perforated with the orifices 4 that introduce the other fluid involved.

Top woven wire mesh or perforated sheet 5 is held tightly against the tops of the flattened pipe or tube 1 to keep the particles 2 from falling out when the heat exchanger is handled. The angle θ between the flattened top surface of pipe 1 and the neighboring downward fold of top woven wire mesh or perforated sheet 5 can be between approximately 30° and 90°. The folded or shaped top woven wire mesh or perforated sheet 5 increases its surface area and decreases the volume of a heat exchanging space which will thereby reduce the overall pressure drop when in service.

Bottom woven wire mesh or perforated sheet 6 is held tightly against the bottom or inlet side of the grid plate 3 to keep the particles 2 from draining out from between neighboring pipes 1 whenever the heat exchanger has no upwardly flowing fluid through the orifices as indicated by the upwardly rising direction of arrows A. Bubbles 7 are formed above the orifices 4 whenever more fluid is introduced through the orifices 4 than will readily pass through the interstices between solid particles 2.

Figure 2:
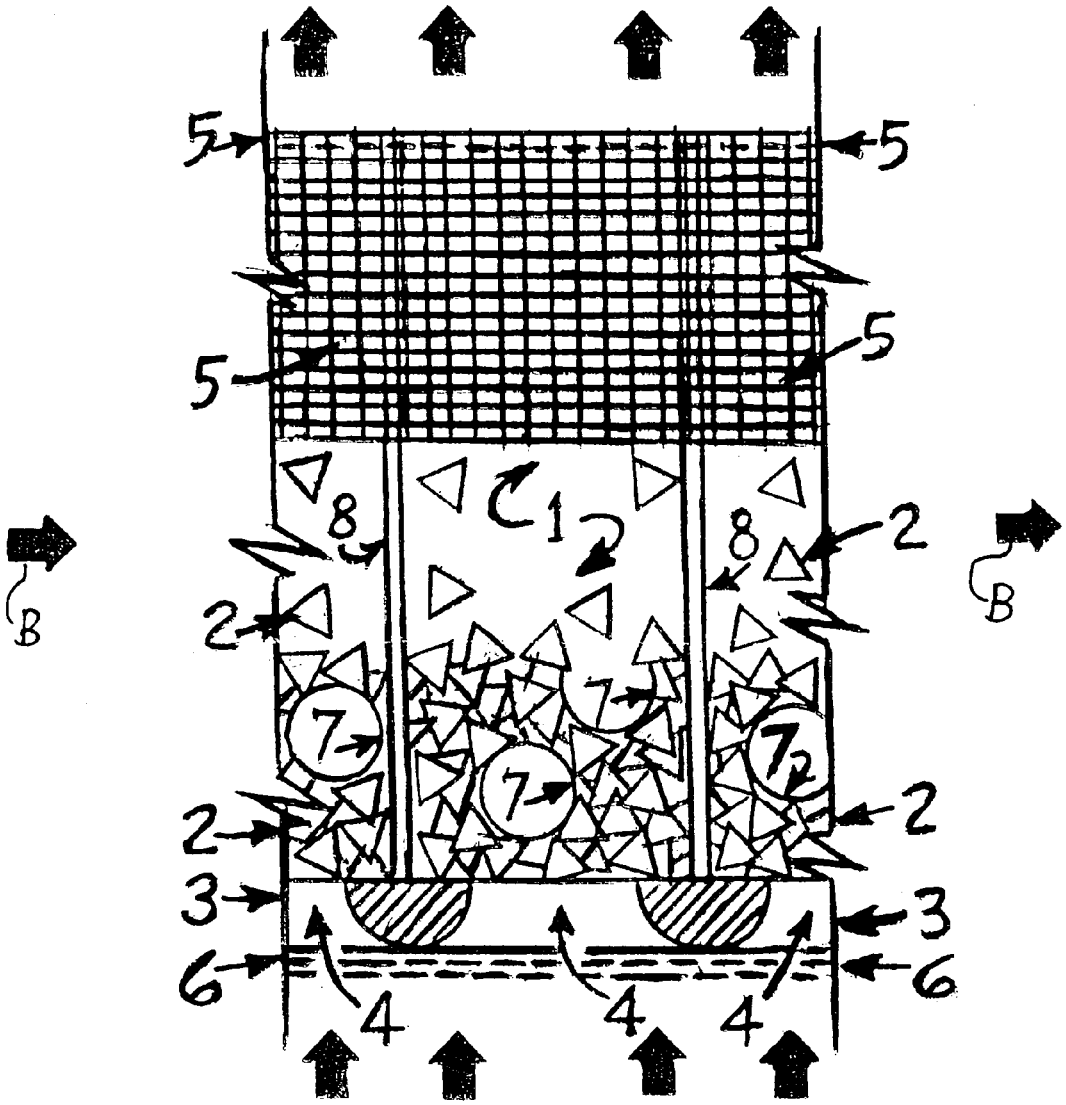
FIG. 2 is a cross-sectional view taken along lines II–II' of FIG. 1.

FIG. 2 is a cross-sectional view of the heat exchanger that is taken along cross-sectional line II–II' in FIG. 1. The side of pipe 1 that conveys the horizontally flowing fluid is shown as well as its fluid flow that is indicated by arrows B that point from left to right. Particles 2, grid plate 3 perforated by orifices 4, upper wire mesh 5, lower wire mesh 6, and bubbles 7 are shown again. Pitch divider fins 8 are spaced-apart from each other and coupled to two spaced-apart and adjacent flat surfaces of pipes 2 facing each other and are provided in order to increase heat transfer surface even when the heat exchanger is not pitched for drainage. Particles 2 move within the heat exchanging space defined by the two spaced-apart pitch divider fins 8, two spaced-apart flat surfaces of pipes 1, upper wire mesh 5, and lower wire mesh 6.

Figure 3A:
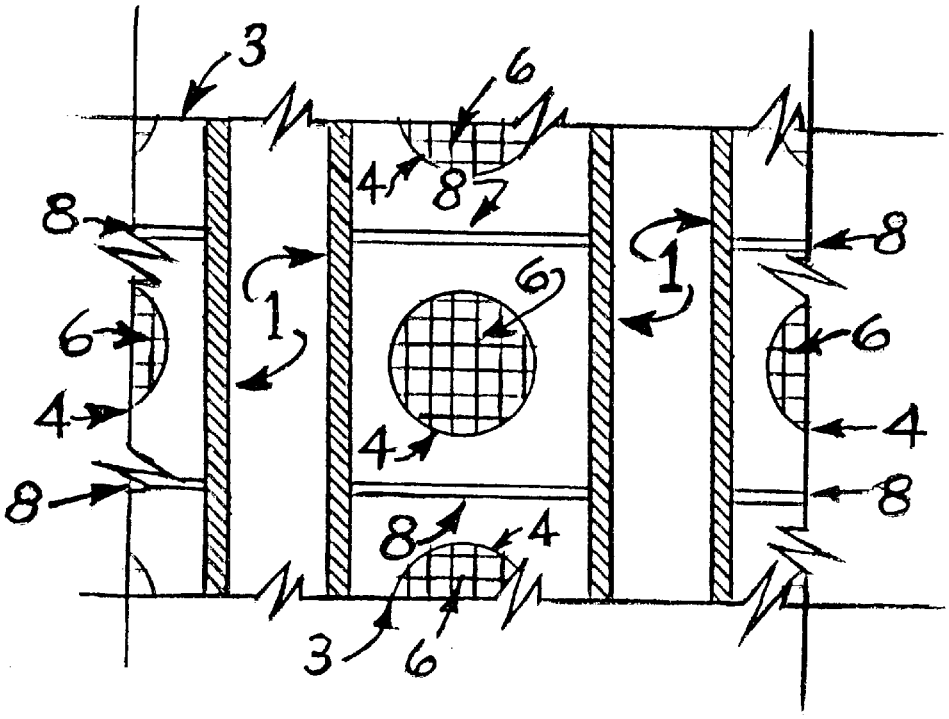
FIGS. 3A, 3B, 3C and 3D are top views of the orifice plate showing various configurations and types of orifices that may be employed in the construction of a heat exchanger in accordance with the principles of the present invention.

FIG. 3A shows a top view of grid plate 3 where shown in FIGS. 1 and 2. There is only one orifice 4 shown in the area bounded by the walls of the flattened pipe or tubing 1 and two adjacent pitch divider fins 8.

Figure 3B:
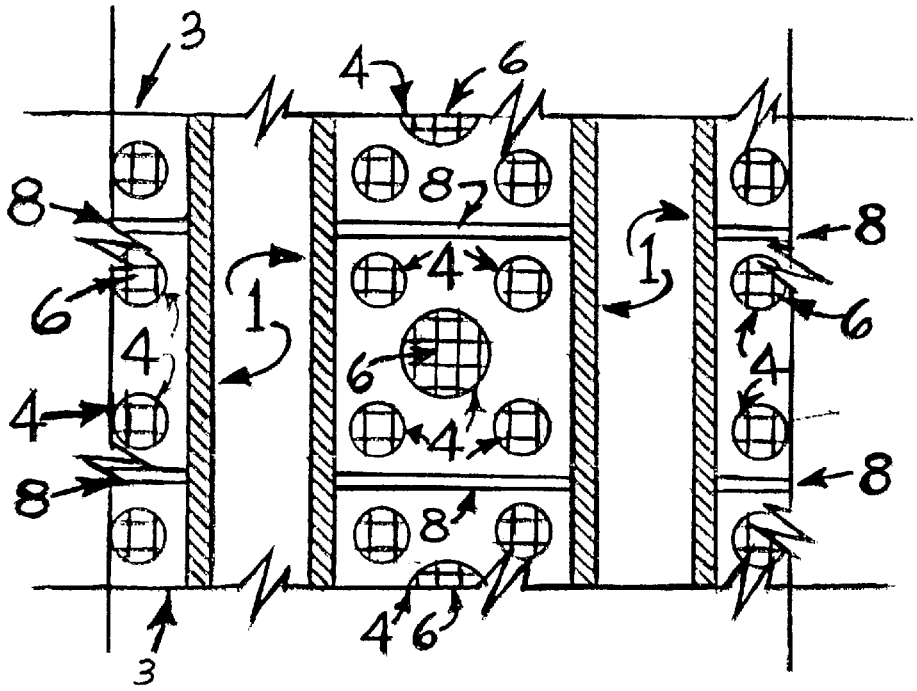

FIG. 3B shows a second embodiment of grid plate 3 constructed according to the principle of the present invention. One orifice is shown centered in the area bounded by the walls of the flattened pipe or tubing 1 and two adjacent pitch divider fins 8 with four other orifices 4 located each one in each corner.

Figure 3C:
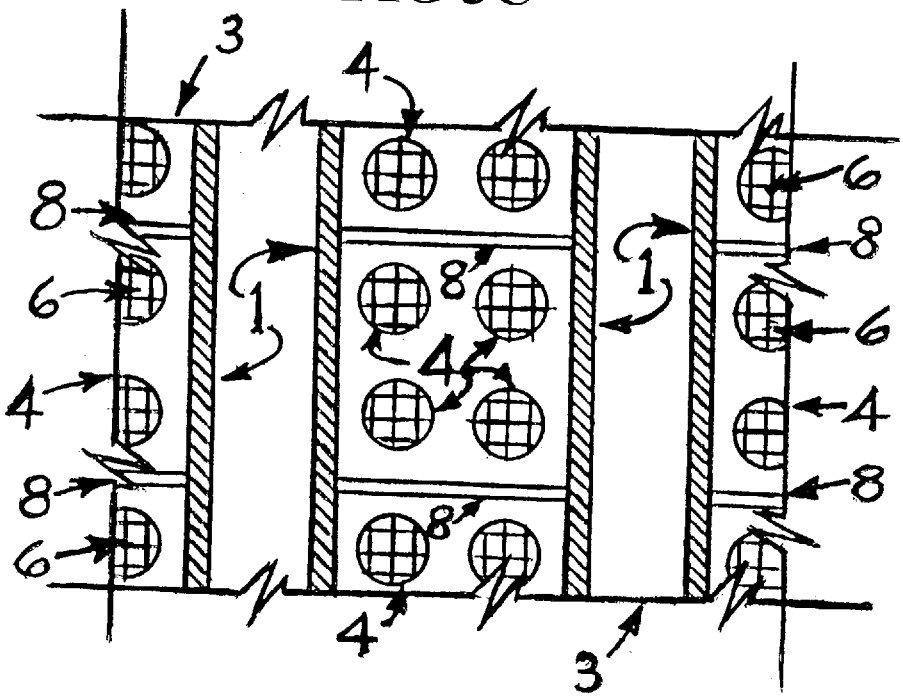

FIG. 3C shows a third embodiment of grid plate 3. Four orifices 4 are shown in the area bounded by the walls of the flattened pipe or tubing 1 and two adjacent pitch divider fins 8.

Figure 3D:
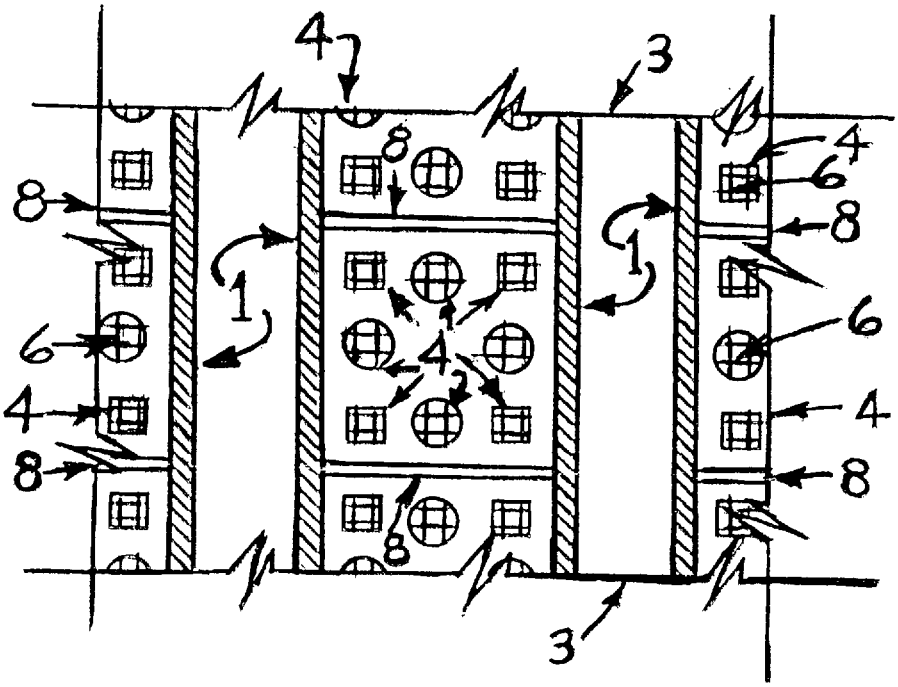

FIG. 3D shows a fourth embodiment of grid plate 3. Eight orifices 4 are shown in the area bounded by the walls of the flattened pipe or tubing 1 and two adjacent pitch divider fins 8. Four of orifices 4 are shown as squares. The orifices 4 can be round, square, elliptical or polygonal.

Figure 4:
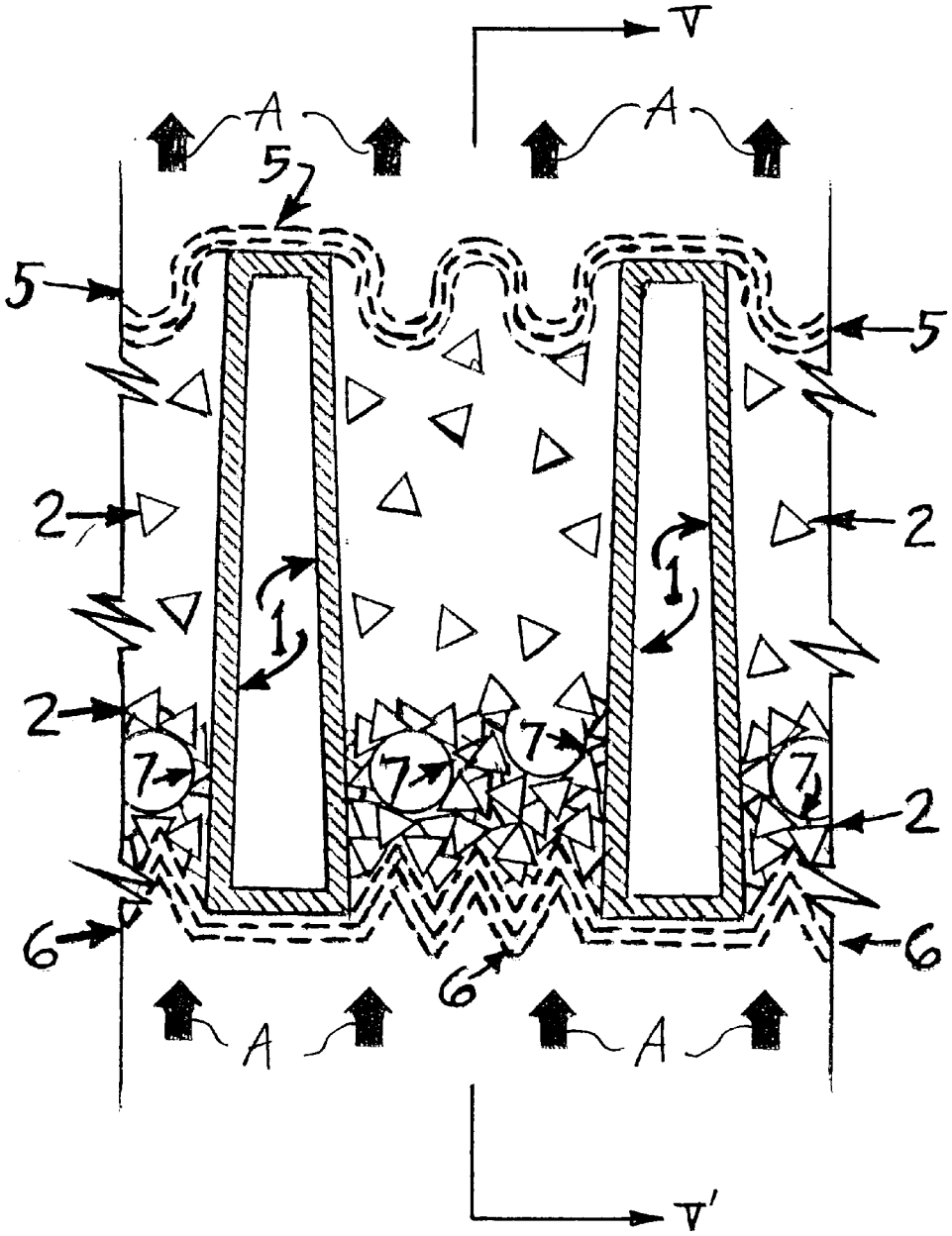
FIG. 4 is a cross-sectional view of another embodiment of the heat exchanger constructed according to the principles of the present invention.

FIG. 4 is a cross-sectional view of the heat exchanger that is taken at a right angle to the flat surfaced pipe or tubing 1 that conveys one of the fluids involved horizontally. The small solid particles 2 are drawn as triangles to represent tetrahedrons (which is one of the preferred solid shapes). The flattened pipe or tubing 1 is firmly attached to bottom woven wire mesh or perforated sheet 6 which is shown as formed into flat-sided alternating ridges and groves. Note that there is no grid plate 3 required for this construction. The top woven wire mesh or perforated sheet 5 is held tightly against the tops of the flattened pipe or tubing 1 to keep the small solid particles 2 from falling out when the heat exchangers are handled. Note that the top woven wire mesh or perforated sheet 5 is now shown as being formed into rounded alternating ridges and groves which will result in less pressure drop through the heat exchangers when in service. The large dark arrows A that point up indicate the upward flowing fluid. Bubbles 7 are formed above the bottom woven wire mesh or perforated sheet 6 whenever more fluid is introduced than will pass through the spaces between the small solid particles 2.

Figure 5:
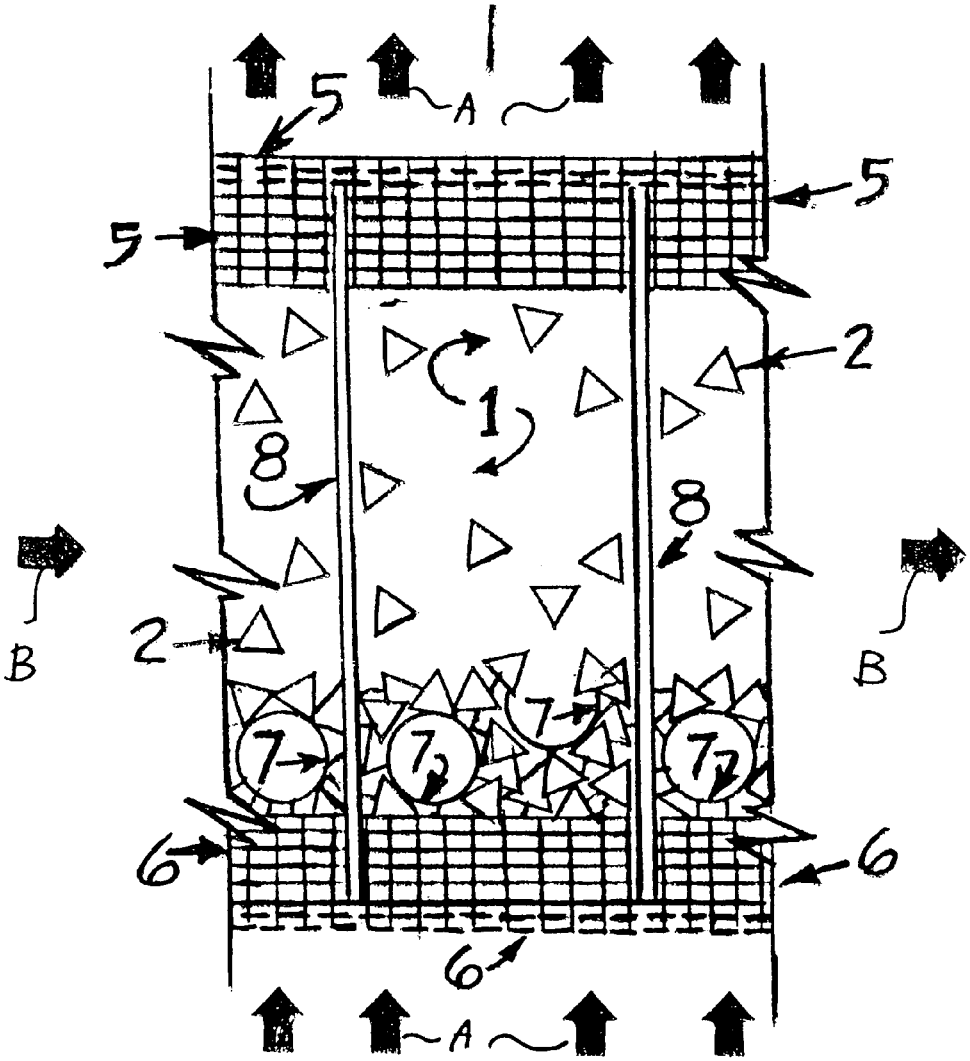
FIG. 5 is a cross-sectional view taken along lines V–V' of FIG. 4.

FIG. 5 is a cross-sectional view of the heat exchanger that is taken at a right angle to FIG. 4 as shown in FIG. 4. The side of the flattened pipe or tubing 1 that conveys the horizontally flowing fluid is shown as well as its fluid flow that is indicated by the large dark arrows B that point from left to right. The small solid particles 2, the top woven wire mesh or perforated sheet 5, the bottom woven wire mesh or perforated sheet 6, and the bubbles 7 are shown again as shown in FIG. 4. Pitch divider fins 8 are shown as being provided for increased heat transfer surface even when the heat exchanger is not pitched for drainage.

Figure 6A:
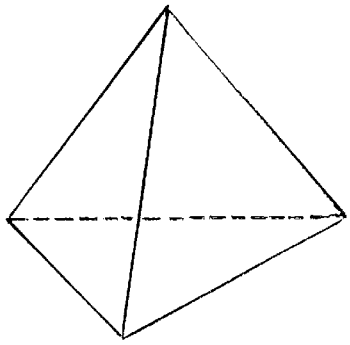
FIGS. 6A, 6B, 6C and 6D are three-dimensional views of small particles that may be manufactured that are with shapes of tetrahedrons or pyramids for use in a heat exchanger constructed according to the principles of the present invention.
Figure 6B:
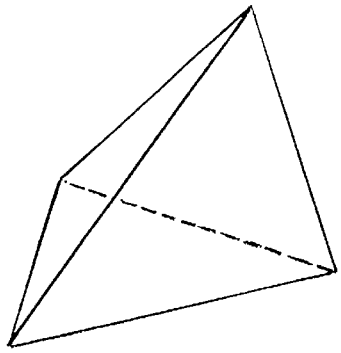
Figure 6C:
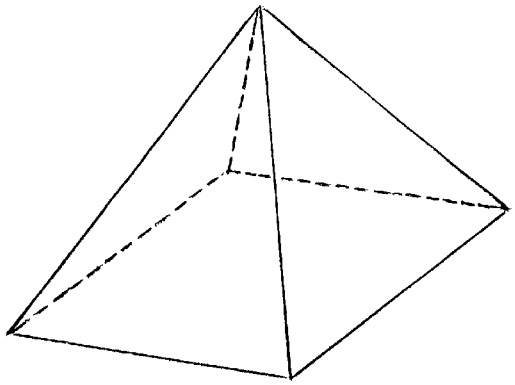
Figure 6D:
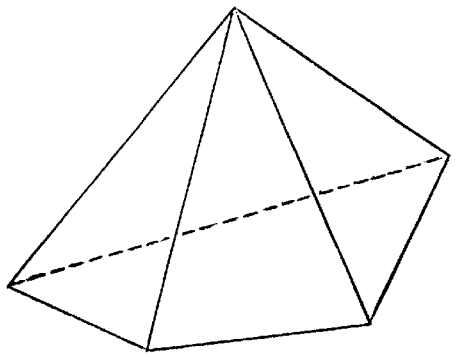

FIG. 6A shows a shape of small solid particles having a tetrahedron that has all four equilateral triangles of the same size where the side lengths are all equal. FIG. 6B shows a tetrahedron that has four triangular faces that are not necessarily equal including the case where all four triangles could be of different dimensions. FIG. 6C shows a pyramid that has four triangles that are of equal dimensions and the base is a square. FIG. 6D shows a polyhedron that has a polygonal base with triangular sides that meet at a common vertex. The tetrahedron shown as FIG. 6A is expected to be the most used shape for the small solid particles to be manufactured.

According to the present invention as described above, the heat exchanger is reduced in size and exhibits much higher heat transfer rates when using the grid plate perforated with a plurality of orifices, the folded or shaped woven wire mesh or perforated sheets on the top and bottom of the heat exchanger, and tetrahedron or pyramid shaped small solid particles. The use of folded or shaped woven wire mesh or perforated sheets reduce the overall pressure drop within the heat exchanger when in service Although the preferred embodiment of the present invention has been shown and described, it will be appreciated by those skilled in the art that changes may be made in these embodiments without departing from the principles and spirit of the invention, the scope of which is defined in the claims and their equivalents.

What is claimed is:

1. A heat exchanger comprising:

a plurality of substantially parallel conduits spaced-apart in an array to convey a first fluid through said heat exchanger, said conduits each having a first plurality of flat surfaces;

a plate attached to a first side of said heat exchanger and perforated by a plurality of orifices conveying a second fluid through said heat exchanger;

a permeable first cover attached to a second side of said heat exchanger, said first cover being spaced-apart from said plate by said plurality of conduits and defining a plurality of interstices between said conduits, said first cover corrugated with rounded or flat sided ridges;

a second permeable cover attached to said plate; and a plurality of small solid particles distributed within said interstices, said small solid particles having a second plurality of flat surfaces contactable against said first plurality of flat surfaces to transfer heat between said first fluid and said second fluid.

2. The heat exchanger of claim 1, further comprising a plurality of pitch divider fins spaced-apart from each other and disposed between said flat surfaces facing each other to define said interstices bounded by said flat surfaces and two adjacent pitch divider fins.

3. The heat exchanger of claim 2, with said plate comprising only one orifice located within said interstices.

4. The heat exchanger of claim 2, with said plate comprising any one of either four orifices located one in each corner of said interstices with one orifice in a central portion of said area, four orifices located one in each corner of said interstices, and at least two orifices spaced-apart from each other within said interstices.

5. The heat exchanger of claim 1, with said orifices being round, square, elliptical or polygonal.

6. The heat exchanger of claim 1, with said first cover having a flat-sided ridge bent into a space occupied by said small solid particles.

7. The heat exchanger of claim 6, wherein said flat-sided ridge is bent with an angle from 30° to 90° with respect to adjacent one of said flat surfaces.

8. The heat exchanger of claim 1, wherein said small solid particles are any one of either a first tetrahedron having four equilateral triangles of the same size, a second tetrahedron having four triangular faces that are not necessarily equal, a pyramid having four triangles that are of equal dimensions with a square base, and a polyhedron with a polygonal base and with triangular sides that meet at a common vertex.

9. The heat exchanger of claim 1, said small solid particles having dimensions of length range from about 0.005" to about 1.00".

10. A heat exchanger comprising:

a plurality of substantially parallel conduits spaced-apart in an array to convey a first fluid through said heat exchanger, said conduits each having a first plurality of flat surfaces;

a permeable first cover attached to a first side of said heat exchanger and corrugated with rounded or flat sided ridges;

a permeable second cover attached to a second side of said heat exchanger, said second cover being spaced-apart from said first cover and defining a plurality of interstices between said conduits to convey a second fluid; and a plurality of small solid particles distributed within said interstices, said small solid particles having a second plurality of flat surfaces contactable with said first plurality of flat surfaces of said passage to transfer heat between said first fluid and said second fluid.

11. The heat exchanger of claim 10, with said second cover having a flat-sided ridge bent into a space occupied by said small solid particles.

12. The heat exchanger of claim 11, wherein said flat-sided ridge is bent with an angle from 30° to 90° with respect to adjacent one of said flat surfaces.

13. The heat exchanger of claim 10, wherein said small solid particles are any one of either a first tetrahedron having four equilateral triangles of the same size, a second tetrahedron having four triangular faces that are not necessarily equal, said pyramid having four triangles that are of equal dimensions with a square base, and said polyhedron with a polygonal base and with triangular sides that meet at a common vertex.

14. The heat exchanger of claim 10, said small solid particles having dimensions of length range from about 0.005" to about 1.00".

15. The heat exchanger of claim 10, further comprising a grid plate attached on a bottom side of said heat exchanger and perforated by orifice conveying said second fluid through said heat exchanger to fluidize a plurality of said small solid particles.

16. The heat exchanger of claim 15, with said grid plate comprising any one of either four orifices located one in each corner of said interstices with one orifice in a central portion of said interstices, four orifices located one in each corner, and at least two orifices spaced-apart from each other.

17. The heat exchanger of claim 15, with said orifices being round, square, elliptical or polygonal.

18. The heat exchanger of claim 10, wherein said small solid particles are any one of either a first tetrahedron having four equilateral triangles of the same size, a second tetrahedron having four triangular faces that are not necessarily equal, a pyramid having four triangles that are of equal dimensions with a square base, and a polyhedron with a polygonal base and with triangular sides that meet at a common vertex.

* * * * *